US005289182A

United States Patent [19]

Brillard et al.

[11] Patent Number: 5,289,182

[45] Date of Patent: Feb. 22, 1994

[54] ELECTRONIC ANTI-COLLISON DEVICE CARRIED ON BOARD A VEHICLE

[75] Inventors: Guy Brillard, Garges les Gonesse; Eric Brillard, Saint-Maur des Fosses; Jean-Claude Crueize, Moussy-le-Neuf, all of France

[73] Assignee: II BC-SYS, Saint-Maur des Fosses, France

[21] Appl. No.: 818,293

[22] Filed: Jan. 9, 1992

[30] Foreign Application Priority Data

Oct. 16, 1991 [FR] France ..... 91 12745

[51] Int. Cl.[5] ..... G08G 1/00

[52] U.S. Cl. ..... 340/902; 340/903; 340/435; 340/479

[58] Field of Search ..... 340/902, 903, 904, 901, 340/435, 479, 467; 307/10.8; 180/167

[56] References Cited

U.S. PATENT DOCUMENTS 4,706,086 11/1987 Panizza ..... 340/902
5,111,182 5/1992 Ishikawa et al. ..... 340/903 X

FOREIGN PATENT DOCUMENTS 2642211 6/1978 Fed. Rep. of Germany .
2818770 10/1979 Fed. Rep. of Germany .
3811324 1/1989 Fed. Rep. of Germany .
2562694 10/1985 France .
2175462 11/1986 United Kingdom .

*Primary Examiner*—Jeffrey Hofsass
*Attorney, Agent, or Firm*—W. Thad Adams, III

[57] ABSTRACT

An electronic device for being carried on a vehicle for transmitting information to a vehicle following it over a given route. The electronic device is also intended to receive information coming from a vehicle preceding it over the same route. The device includes a transmitter for transmitting information and a chronometric scanner adapted to detect deceleration of the vehicle by comparing speed values communicated to it by sensor. In the event that deceleration values exceed a certain threshold, a signal is sent to a radio transmitter device adapted to transmit a deceleration signal via an antenna on the rear of the vehicle. The electronic device also includes a radio receiver for receiving information from an antenna at the front of the vehicle regarding deceleration of vehicle in front of the vehicle. An alarm device emits a visual and/or audible alarm in the event of sudden deceleration of a vehicle preceding it.

15 Claims, 1 Drawing Sheet

ELECTRONIC ANTI-COLLISON DEVICE CARRIED ON BOARD A VEHICLE

The present invention relates to a device intended to inform instantaneously, outside built-up areas, mutually concerned motorists that an imminent, more or less sudden slowing down has just taken place and/or is going to take place.

BACKGROUND OF THE INVENTION

The present technique used to warn a succession of motorists that one of them is slowing down or stopping, consists in providing vehicles with stop lights, the lighting of which is subject to the actuation of the brake pedal. When a vehicle is braked, its stop lights come on but only the immediately following driver can perceive this signal. The third driver in line does not begin to brake until the stop lights of the second vehicle come on, and so on. This results in cumulative information delays which may end up in a multiple pileup if one of the drivers is distracted or slow to react, if he is travelling too close to the preceding vehicle or if the visibility conditions are poor. The phenomenon is accentuated by the disparity in braking performance from one vehicle to another and in their respective loading.

SUMMARY OF THE INVENTION

The aim of the present invention is to remedy these disadvantages by proposing to carry on board the vehicle an electronic device adapted to the transmission of information to a vehicle following it over a given route and to the receiving of information coming from a vehicle preceding it over this same route.

More precisely, the device according to the invention comprises:

for transmitting information:

a chronometric scanner adapted to detect a possible deceleration of the vehicle by comparing, at specific time intervals, the values of speed following one another such as they are communicated to it by an appropriate sensor and, in the event that deceleration detected exceeds a certain threshold, to send a corresponding signal to a radio transmitter device;

such a transmitter device adapted to emit a deceleration signal via a directional antenna placed at the rear of the vehicle, and for receiving information:

a radio receiver device adapted to receive, via a directional antenna placed at the front of the vehicle, a deceleration signal emitted by a vehicle preceding it and to transmit it to an electronic box, such an alarm circuit includes alarm circuitry and adapted to emit, in the event of receiving a deceleration signal, a visual and/or audible alarm in the passenger compartment of the vehicle, the said transmitter and receiver being connected to a frequency selector controlled as a function of the direction of traffic and of the route taken by the vehicle.

By virtue of this set of facilities, the device resolves the problem of the cumulative delays by instantaneously alerting the motorists concerned, regardless of the conditions of visibility and regardless of the reaction or the behaviour of the motorists interposed between the vehicle at the cause of the slowing down and a given following motorist.

This clearly results in an improvement in traffic safety.

The choice of the frequencies as a function of the direction of the traffic and of the route taken by the vehicle is intended to prevent interference from occurring between the information coming from vehicles travelling in different directions or in any other contentious case.

According to the invention, each of the said selectable frequencies corresponds to a predetermined range of azimuthal sections.

In a first embodiment of the invention, the frequency selector is manually controlled and is associated with a source of information giving the correspondence between, on the one hand, the route and the direction of traffic and, on the other hand, the appropriate frequency.

The source of information can be an on-board manual or consist of signalling boards installed on the verge of the route followed by the vehicle.

In a second embodiment, the frequency selector is adapted to be remotely switched under the control of emitter terminals installed on the verge of the route followed by the vehicle.

The selectable frequencies advantageously lie between 1 and 2 gigahertz.

In a preferred embodiment of the invention, the chronometric scanner is adapted to send selectively two different signals according to the intensity of the deceleration—sudden or intense—and the box is adapted to emit selectively two different alarms, visual and/or audible, as a function of the deceleration signal received.

In practice, the chronometric scanner can emit a sudden deceleration signal when it detects a deceleration greater than 20 km/h within three seconds or less and an intense deceleration signal when it detects a deceleration greater than 20 km/h within four to ten seconds.

Also preferably, the transmitter is furthermore functionally joined to the device for controlling the main beam headlights, fog lights and dipped headlights, and from which it receives a signal when the said lights are lit, the said transmitter being adapted to emit a corresponding closeness signal, and the said box being adapted, on receiving this closeness signal, to emit a visual and/or audible closeness alarm.

This facility is specifically adapted to traffic flow in foggy weather or any other condition requiring the lighting of the dipped headlights, of the fog lights or of the main beam headlights.

With several situations able to occur simultaneously, an order of priority must be established. To this end, the device comprises selector means adapted, in the event that the transmitter and/or the receiver are called upon simultaneously by a deceleration signal and by a closeness signal, to give priority to the deceleration signal and selector means adapted, in the event that the transmitter and/or the receiver are called upon simultaneously by a sudden deceleration signal and by an intense deceleration signal, to give priority to the sudden deceleration signal.

In practice, the antennas for transmission and for reception are oriented horizontally in a plane perpendicular to the direction of motion of the vehicle and the range of the transmitter and receiver devices is less than or equal to about 1000 meters.

BRIEF DESCRIPTION OF THE DRAWING

An embodiment of the invention is described below with further details through reference to the single sheet of the attached drawing which is a block diagram of the device.

DESCRIPTION OF THE PREFERRED EMBODIMENT(S)

Figure 1:
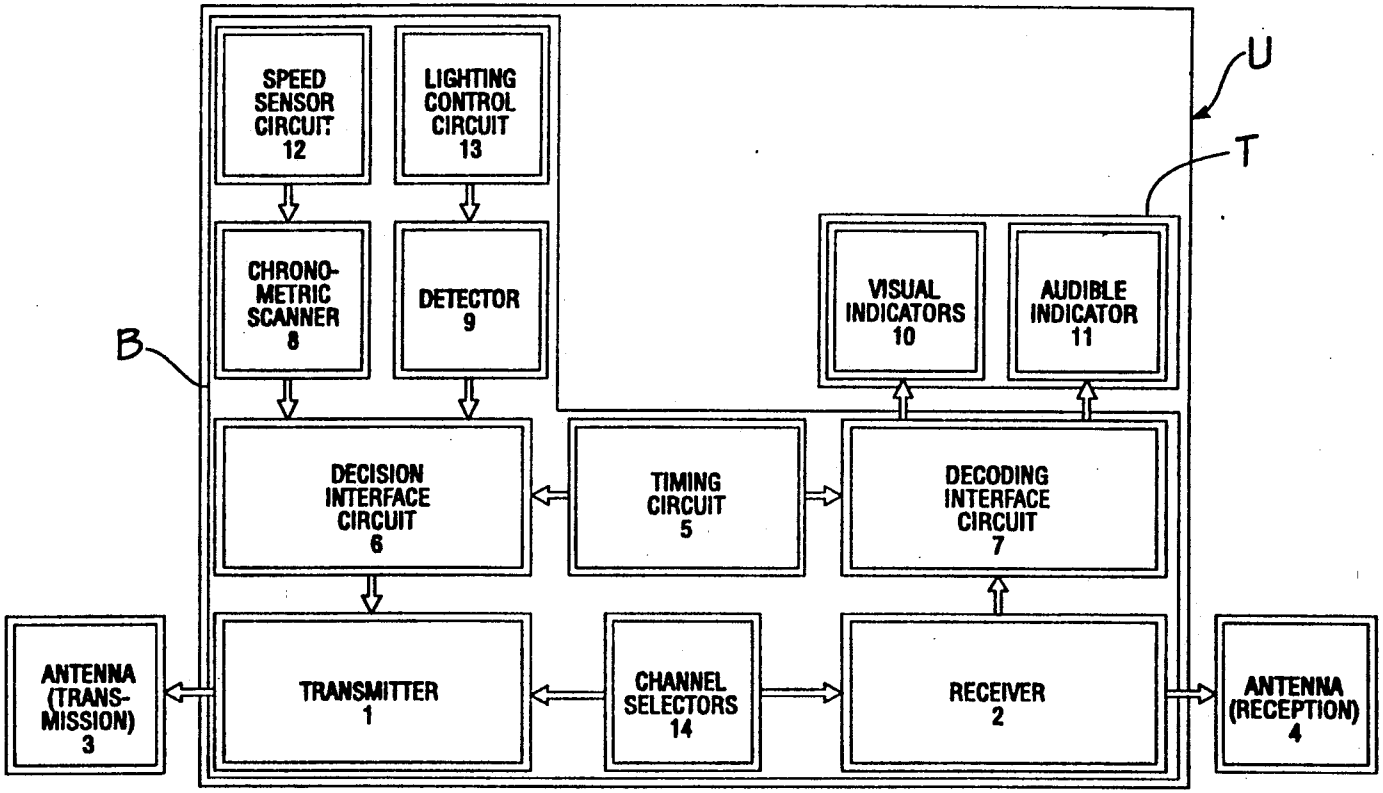

The device according to the invention comprises, on the one hand, a unit U which is supplied electrically by connection to the battery of the vehicle and, on the other hand, a transmission antenna 3 and a reception antenna 4. The unit U is advantageously subdivided into a "black box" B housed anywhere in the vehicle, and into a control and information panel T connected to the said black box B and placed inside the passenger compartment of the vehicle, in such a way as to be visible to the driver and accessible to the latter.

The black box B contains a transmitter 1 and a receiver 2. The transmitter 1, which transmits via the transmission antenna 3, is subject to an automatic decision interface 6 connected, on the one hand, to an electronic speed-measuring device or chronometric scanner 8 receiving its information from a speed sensor 12 and, on the other hand, to an electronic detector 9 connected to the dipped headlights/fog lights/main beam headlights lighting control 13. The receiver 2, which receives its information from the reception antenna 4, transmits it to a decoding interface 7 which addresses it to a series 10 of visual indicators and to an audible indicator 11 belonging to the control and information panel T.

The automatic decision interface 6 and the decoding interface 7 are linked with a time base 5. These three components constitute a subassembly, referred to as the "electronic box" of the black box B.

The series 10 of visual indicators consists of three warning lights coloured red, orange and green. The audible indicator 11 consists of a loudspeaker or buzzer associated with a potentiometer for adjusting the volume (not shown) and coupled to a switch for turning on and off (also not shown).

The transmitter 1 and the receiver 2 are subject to a multi-position channel selector 14 (oscillator with frequency synthesizer).

The function of the frequency selector 14 is to take account of the general orientation of the route followed by the vehicle and of its direction of traffic.

In the version represented, the frequency selector 14 can be remotely switched under the control of emitter terminals installed on the verge of the road, and it belongs to the black box B.

If the frequency selector 14 were manually controlled, it would belong to the control and information panel T and would be adjusted to the desired frequency by reference to an item of information given to the driver either by an on-board user manual, or by signalling boards installed on the verge of the road.

The operating principle provides for, on taking to the road, the automatic triggering of low-range transmissions coded variously according to three causes:

first cause: a sudden slowing down of the vehicle by more than about 20 km/h within three seconds or less caused by sudden braking or the colliding of the vehicle with an obstacle;

second cause: a considerable slowing down of the vehicle by more than 20 km/h occurring within about four to ten seconds;

third cause: the lighting of the dipped headlights, of the fog lights or of the main beam headlights.

The coding of the transmissions/receptions depending on the cause, may be as follows:

a) first cause: emission of a continuous signal for 4 seconds. On reception, this continuous 4 second signal is echoed by the buzzer and visualised by the lighting of the red warning light for 4 seconds;

b) second cause: emission of a modulated tone for 2 seconds every 2 seconds. On reception, this modulated signal is echoed by the buzzer and visualised by the lighting of the orange warning light for 2 seconds every 2 seconds;

c) third cause: emission for 1 second of several modulated tones every 30 seconds. On reception, this signal is visualised by the lighting of the orange warning light with the same buzzer on-time, namely 1 second every 30 seconds.

On powerinq-up, a self-testing sequence is activated, attesting to the correct functioning of the warning lights and of the buzzer. The green warning light remains lit in order to indicate that the apparatus is on standby and it is off while the other warning lights are on.

The reception of a message by the antenna 4 situated at the front of the vehicle is manifested by the sound of the buzzer and the lighting of the warning lights. It is not related to the transmission of signals by the antenna 3 situated at the rear of the vehicle, which transmission stems from one of the three abovementioned causes reflecting the actual situation of the vehicle. These two functions may be fulfilled simultaneously without any interference within the same system.

It is clearly understood that the invention is not limited to the embodiment described and represented and that it could be implemented within the context of vehicles other than motor vehicles.

We claim:

1. An electronic device carried on board vehicles and for transmitting information from a vehicle to a vehicle following it over a given route and for receiving information coming from a vehicle preceding it over this same route wherein there is provided:

for transmitting information:

a chronometric scanner adapted to detect a possible deceleration of the vehicle by comparing, at specific time intervals values of speed such that said values of speed are communicated to said scanner by a sensor and, in the event that the deceleration detected exceeds a certain threshold, to send a corresponding signal to a radio transmitter device;

said radio transmitter device adapted to transmit a deceleration signal via a directional antenna placed at the rear of the vehicle, and for receiving information:

a radio receiver device adapted to receive, via a directional antenna placed at the front of the vehicle, a deceleration signal emitted by a vehicle preceding it and to transmit said deceleration signal to an alarm circuit, said alarm circuit adapted to emit, in the event of receiving a deceleration signal, a visual and/or audible alarm in the passenger compartment of the vehicle, and the said transmitter and said receiver are connected to a frequency selector which is manually or automatically controlled to select a frequency based upon the direction of the traffic and of the route taken by the vehicle.

2. Device according to claim 1, wherein said frequency selector includes a plurality of associated selectable frequencies corresponding to a predetermined range of azimuthal sections.

3. The device according to claim 1, wherein the frequency selector is manually controlled and wherein it is associated with a source of information giving the correspondence between, on the one hand, the route and the direction of the traffic and, on the other hand, the appropriate frequency 4. The device according to claim 1, wherein the frequency selector is manually controlled and wherein it is associated with an on-board manual giving the correspondence between, on the one hand, the route and the direction of the traffic and, on the other hand, the appropriate frequency.

5. The device according to claim 1, wherein the frequency selector is manually controlled and wherein it is associated with signalling boards installed on the verge of the route followed by the vehicle, said signalling boards giving the appropriate frequency which corresponds to the route and the direction of the traffic.

6. The device according to claim 1, wherein the frequency selector is adapted to be remotely switched under the control of emitter terminals installed on the verge of the route followed by the vehicle.

7. The device according to claim 2, wherein the selectable frequencies lie between 1 and 2 gigahertz.

8. The device according to claim 1, wherein the chronometric scanner is adapted to send selectively two different signals according to the intensity of the deceleration - sudden or intense - and wherein the alarm circuit of a following vehicle is adapted to emit selectively two different alarms, visual and/or audible, as a function of the deceleration signal received.

9. The device according to claim 1, wherein the chronometric scanner is adapted to emit selectively a sudden deceleration signal, when it detects a deceleration greater than 20 km/h within three seconds or less, and a different signal when it detects an intense deceleration and wherein the alarm circuit of a following vehicle is adapted to emit selectively two different alarms, visual and/or audible, as a function of the deceleration signal - sudden or intense - received.

10. The device according to claim 1, wherein the chronometric scanner is adapted to emit selectively an intense deceleration signal when it detects a deceleration greater than 20 km/h within four to ten seconds, and a different signal when it detects an sudden deceleration and wherein the alarm circuit of a following vehicle is adapted to emit selectively two different alarms, visual and/or audible, as a function of the deceleration signal - intense or sudden - received.

11. The device according to claim 1, wherein the transmitter is furthermore functionally joined to a device for controlling main beam headlights, fog lights and dipped headlights, and from which said transmitter receives a signal when the said lights are lit, wherein the said transmitter is adapted to transmit a corresponding closeness signal, and wherein the said alarm circuit of a following vehicle is adapted, on receiving this closeness signal, to emit a visual and/or audible closeness alarm.

12. The device according to claim 1, wherein the transmitter is furthermore functionally joined to a device for controlling main beam headlights, fog lights and dipped headlights, and from which said transmitter receives a signal when the said lights are lit, wherein the said transmitter is adapted to transmit a corresponding closeness signal, and wherein the said alarm circuit of a following vehicle is adapted, on receiving this closeness signal, to emit a visual and/or audible closeness alarm, and wherein there is provided selector means adapted, in the event that the transmitter and/or the receiver are called upon simultaneously by a deceleration signal and by a closeness signal, to give priority to the deceleration signal 13. The device according to claim 1, wherein the chronometric scanner is adapted to send selectively two different signals according to the intensity of the deceleration - sudden or intense -, wherein the alarm circuit of a following vehicle is adapted to emit selectively two different alarms, visual and/or audible, as a function of the deceleration signal received and wherein there is provided selector means adapted, in the event that the transmitter and/or the receiver are called upon simultaneously by a sudden deceleration signal and by an intense deceleration signal, to give priority to the sudden deceleration signal.

14. The device according to claim 1, wherein the antennas for transmission and for reception are oriented horizontally in a plane perpendicular to the direction of motion of the vehicle.

15. The device according to one of claims 1 to 14, wherein the range of the transmitter and receiver devices is less than or equal to about 1000 meters.

* * * * *